United States Patent [19]

Asano et al.

[11] 4,183,335

[45] Jan. 15, 1980

[54] EXHAUST GAS SENSOR OPERATING TEMPERATURE DETECTION FOR FUEL MIXTURE CONTROL SYSTEM

[75] Inventors: Masaharu Asano, Yokosuka; Akio Hosaka, Mori, both of Japan

[73] Assignee: Nissan Motor Company, Limited, Yokohama, Japan

[21] Appl. No.: 863,958

[22] Filed: Dec. 23, 1977

[30] Foreign Application Priority Data

Dec. 27, 1976 [JP] Japan ..... 51/156583

[51] Int. Cl.[2] ..... F02B 3/00

[52] U.S. Cl. ..... 123/119 EC; 123/32 EE

[58] Field of Search ..... 123/119 EC, 32 EE; 60/276, 285, 286

[56] References Cited

U.S. PATENT DOCUMENTS

| | | | |
|---|---|---|---|
| 3,759,232 | 9/1973 | Wahl et al. | 123/32 EE |
| 3,895,611 | 7/1975 | Endo et al. | 60/276 |
| 3,949,551 | 4/1976 | Eichler et al. | 60/276 |
| 3,973,529 | 8/1976 | Wessel et al. | 123/32 EE |
| 3,986,352 | 10/1976 | Casey | 60/276 |
| 4,036,186 | 7/1977 | Hattori et al. | 123/32 EE |
| 4,075,982 | 2/1978 | Asano et al. | 123/32 EE |
| 4,077,207 | 3/1978 | Hattori et al. | 60/276 |
| 4,078,379 | 3/1978 | Minami et al. | 60/276 |
| 4,096,834 | 6/1978 | Norimatsu et al. | 60/276 |
| 4,116,170 | 9/1978 | Anzai | 60/276 |

*Primary Examiner*—Charles J. Myhre
*Assistant Examiner*—R. A. Nell
*Attorney, Agent, or Firm*—Lowe, King, Price & Becker

[57] ABSTRACT

In a fuel mixture control system including an exhaust gas sensor located within an exhaust system of an internal combustion engine, maximum and minimum peak values of the gas sensor output are detected. A direct-current pedestal is added to the detected minimum peak value. A comparator detects when the added minimum peak exceeds the detected maximum peak value to provide a disabling signal to the mixture control system to switch its operational mode from closed loop control to open loop control when the temperature of the gas sensor falls below its operating temperature typically during prolonged idle condition.

3 Claims, 4 Drawing Figures

EXHAUST GAS SENSOR OPERATING TEMPERATURE DETECTION FOR FUEL MIXTURE CONTROL SYSTEM

BACKGROUND OF THE INVENTION

The present invention relates to exhaust gas sensor operating systems and more particularly to an operating temperature detection system for detecting when the operating temperature of the gas sensor is within its normal operating range.

In a closed-loop controlled combustion engine wherein an exhaust gas sensor is positioned in the exhaust system of the engine for generating an output signal for controlling the air-fuel ratio of the mixture supplied to the engine, the sensor must be above a certain temperature in order to operate properly. If the gas sensor is below this temperature, the sensor operation is abnormal resulting in the internal combustion engine operating unsatisfactorily.

When the exhaust gas sensor is operating below its operating temperature during a prolonged idle condition, its internal impedance will become very high and its maximum voltage will decrease, and its minimum voltage, which is usually zero potential, will rise to the decreasing maximum peak values, so that the gas sensor output fluctuates within a decreasing range of values. Copending United States Application No. 715,652 filed on Aug. 19, 1976 assigned to the same assignee as the present application, discloses a system which comprises negative and positive peak detectors for generating a signal of which the magnitude takes on an intermediate value between the varying maximum and minimum peak values of the exhaust gas sensor. The varying intermediate voltage is used as a reference with which the gas sensor output is compared to generate a deviation signal which indicates the deviation of air-fuel ratio within the exhaust system from a near stoichiometry at which catalytic conversion efficiency is maximized.

However, the operating performance of the oxygen sensor varies between different sensors and certain types of oxygen sensor may exhibit a specific characteristic in which the minimum peak values of the sensor also tend to rise when the sensor temperature falls while the maximum peak values decrease, with the resultant narrowing of the range of voltage fluctuations. Although the prior art approach accomplishes prolongation of closed loop operation when the exhaust gas sensor temperature falls during prolonged idle condition, the threshold value will take on an indefinite value within the narrow range so that the closed loop operation will become unsatisfactory. An object of the invention is to prevent meaningless prolongation of closed loop control operation when the exhaust gas sensor operates below its normal operating temperature during prolonged idle condition so as to minimize the emission of noxious waste products.

SUMMARY OF THE INVENTION

According to the invention, there is provided, in a mixture control system for an internal combustion engine having an exhaust gas sensor for supplying a control signal to the mixture control system, a detection system for detecting when the temperature of the gas sensor is at or above its operating temperature to allow said mixture control system to operate in a closed control mode and generating a disabling signal to operate the control system in an open mode when the temperature of the gas sensor is below its operating temperature, wherein the gas sensor is operable to generate low and high voltage signals in response to the presence and absence, respectively, of a predetermined constituent gas in the exhaust gases when operating at or above its normal operating temperature, the gas sensor having an internal impedance varying inversely with the temperature of the gas sensor from a very high impedance at its low, nonoperable temperature to a very low impedance at its high operating temperature, wherein the high voltage signal decreases with the internal impedance and the low voltage signal approaches the decreasing high voltage signal and then decreases with the internal impedance, said detection system comprising, a differential amplifier having a first input terminal receptive of the output from the exhaust gas sensor and a second input terminal receptive of a variable reference voltage for generating a differential signal, a source of voltage of a magnitude intermediate the magnitudes of said high and low voltage signals which will be generated when said exhaust gas sensor is operating at or above its normal operating temperature, means for detecting the low voltage signal, means for adding a predetermined constant DC voltage to the detected low voltage signal, said variable reference voltage being the one of the output from said adding means and said intermediate voltage which is greater than the other, means for detecting said high voltage signal, and a comparator for generating a comparator output when the output from the adding means is greater than the detected high voltage signal, said comparator output being said disabling signal.

DESCRIPTION OF THE PREFERRED EMBODIMENTS

Figure 1:
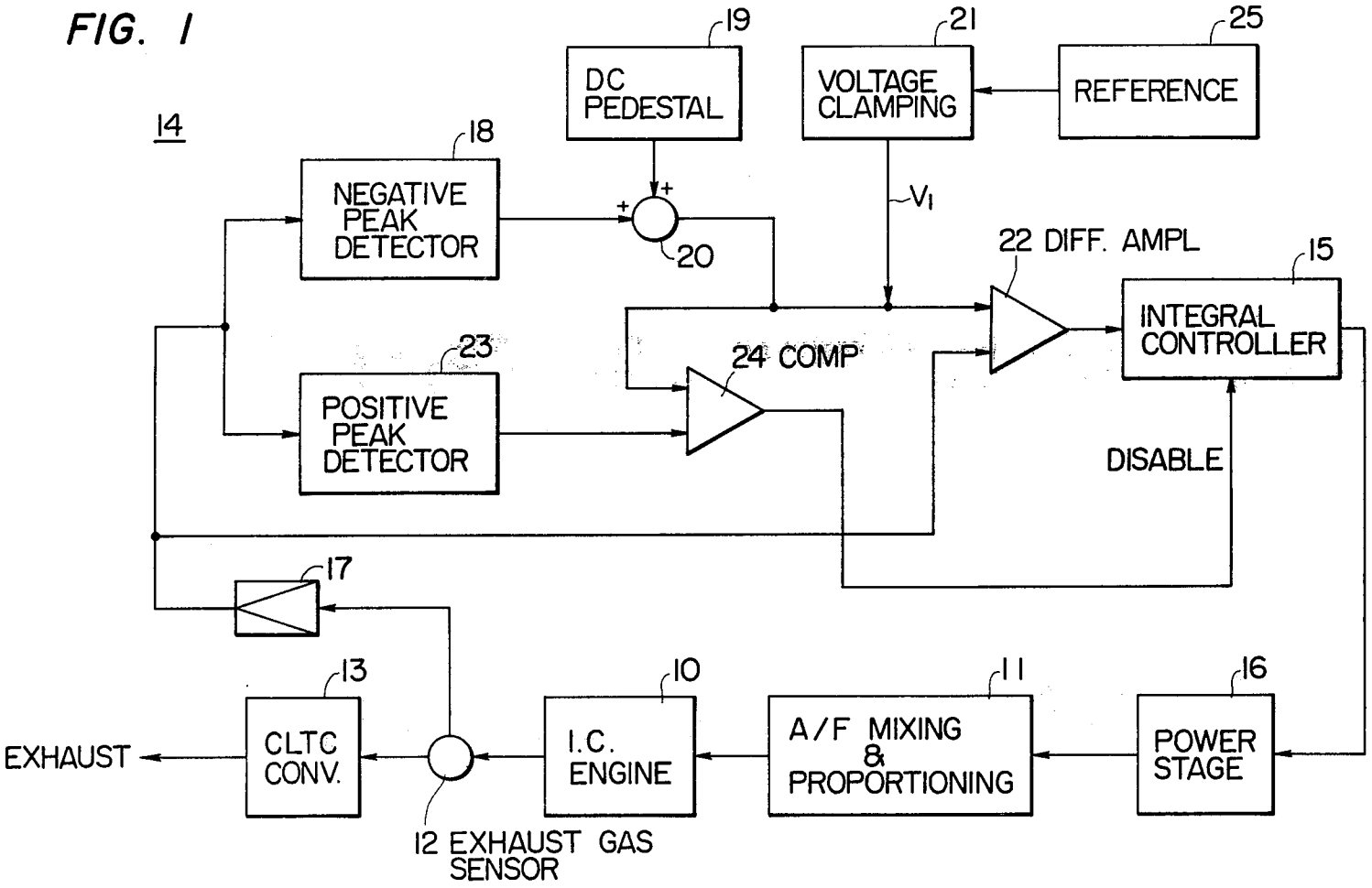
FIG. 1 is a block diagram of an embodiment of the invention.

Referring now to FIG. 1, a closed loop controlled internal combustion engine is illustrated in functional block diagram. An internal combustion engine 10 is supplied with a mixture of air and fuel from an air-fuel mixing and supplying means 11 such as electronically controlled carburetor or injectors and emits its spent gases through the engine's exhaust system in which is disposed an exhaust gas sensor 12 and a catalytic converter 13. In a preferred embodiment, the exhaust gas sensor 12 is a conventional oxygen content detector. One property of the oxygen gas sensor is that a temperature below the normal operating temperature, the internal impedance of the sensor is very high. As the sensor warms up to its normal operating temperature, the internal impedance of the sensor drops from its extremely high value to its operating value.

The exhaust gas sensor operating at or above its normal operating temperature, will generate a high voltage signal in the absence of oxygen so that it represents the mixture richer than stoichiometry. In the presence of oxygen, the gas sensor will generate a low voltage signal which represents the mixture leaner than stoichiometry. When the oxygen sensor is operating below the normal operating temperature, the high voltage signal will decrease with temperature. The catalytic converter 13 is, in a preferred embodiment, of a three-way catalysis type which accelerates simultaneous oxidation of carbon monoxide and hydrocarbon and reduction of nitrogen oxides when it is exposed to the spent gas whose oxygen content indicates the air-fuel ratio being at a point near stoichiometry. Since the three-way catalysis deteriorates in performance as the air-fuel ratio within the exhaust system drifts from the stoichiometric value, the primary function of the closed loop control is to operate the engine 10 with a mixture whose air-fuel ratio is precisely controlled at the near stoichiometry.

The output from the exhaust gas sensor 12 is received by an air-fuel ratio deviation detector 14 whose primary function is to compare the input signal with a variable reference and generate a signal representing the deviation of air-fuel ratio within the exhaust system from the near stoichiometric value at which the three-way catalysis has a maximum conversion efficiency. The output from the deviation detector 14 is fed into an exhaust gas sensor control circuit or integral controller 15 which provides integration of the input signal for the purpose of suppressing undesirable oscillation or fluctuation of feedback control signal which is likely to occur in response to changes in engine's operating conditions.

The output from the integral controller 15 is strengthened by an amplifier power stage 16 and applied to the air-fuel mixing and supplying means 11, and thus the engine 10 is operated in a closed loop control mode.

The deviation detector 14 includes a buffer amplifier 17, a variable reference setting circuit formed by a negative peak detector 18, a DC source 19 which provides a DC pedestal to the detected negative peak value of the oxygen sensor output at a summing junction 20 and a voltage clamping circuit 21 which clamps the voltage at the output of the summing junction to a reference voltage from source 25. The deviation detector 14 further includes a differential amplifier 22 which receives at its first terminal the gas sensor output from amplifier 17 for comparison with a variable reference threshold established at its second input terminal by the output of the summing junction. The second input of the differential amplifier 22 takes on the one of the output voltage of the summing junction 20 and the reference voltage from 25 which is greater than the other.

Figure 3A:
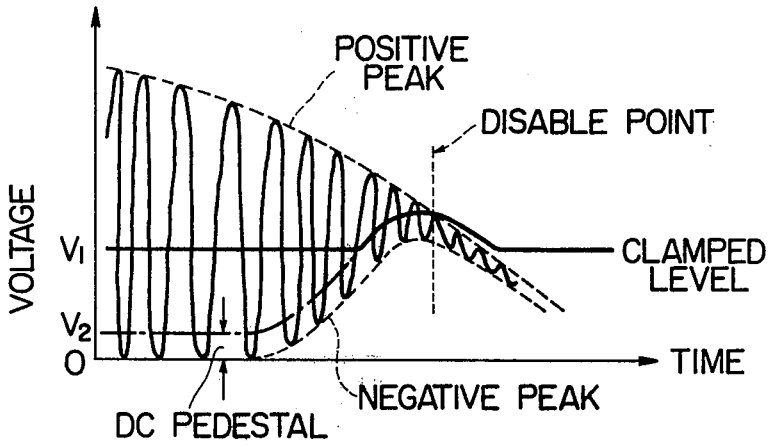
FIGS. 3A and 3B are waveforms appearing in the embodiments of FIGS. 1 and 2, respectively, useful for describing the operation of the respective embodiments.

Negative peak detector 18 is shown connected to the amplifier 17 to provide detection of the sensor's low voltage level and store the detected value so that the output represents the most recent minimum peak level of the gas sensor. The reference voltage from source 25 is set a value intermediate the magnitudes of the high and low voltage signals which will be generated when the exhaust gas sensor is operating at or above its normal operating temperature. Therefore, during the normal closed loop fuel control mode, the threshold level of the differential amplifier 22 is held at $V_1$ (FIG. 3A). Assuming that idle condition has caused the gas sensor temperature to gradually decrease, the maximum peak level of the sensor output decreases with time as indicated in FIG. 3A.

Another property of the oxygen gas sensor 12 is that its minimum peak level starts to increase when the gas sensor temperature drops below a predetermined temperature, approaches the decreasing maximum voltage excrusion and then starts to decrease with a narrow range of fluctuations between the maximum and minimum peaks, as clearly shown in FIG. 3A. Therefore, the summation output will become greater than the reference voltage from source 25 when the gas sensor temperature reaches a certain point whereupon the threshold of the differential amplifier 22 varies with the varying voltage of the summing junction 20.

The magnitude of the DC pedestal $V_2$ is selected so that from a certain point in time onward the summation output should exceed the decreasing maximum peak values. When this occurs, it is desirable to suspend the closed loop control operation because of the inability of the gas sensor to furnish valid signals.

To accomplish the closed loop suspension, a positive peak detector 23 is shown connected to the buffer amplifier 17. Detector 23 detects the maximum peak values of the gas sensor output and holds its over certain period of time so that its output represents the most recent maximum peak value of the gas sensor output. A comparator 24 is shown connected to detector 23 for comparision with the output from the summing junction 20. When the summation output exceeds the positive peak detector output, a disabling signal is delivered to the integrator 15 to suspend the closed loop operation.

As the disabling point approaches, the threshold level also approaches the positive peak values so that the control point is drifted toward the rich side of stoichiometric. As a result, the engine is enriched to maintain its stability during such prolonged idle condition at the end of the closed-loop control mode.

When disabling occurs, the summation output decreases with time until it reaches the reference level $V_1$. This voltage is also used as a threshold when the closed loop operation is resumed.

Figure 2:
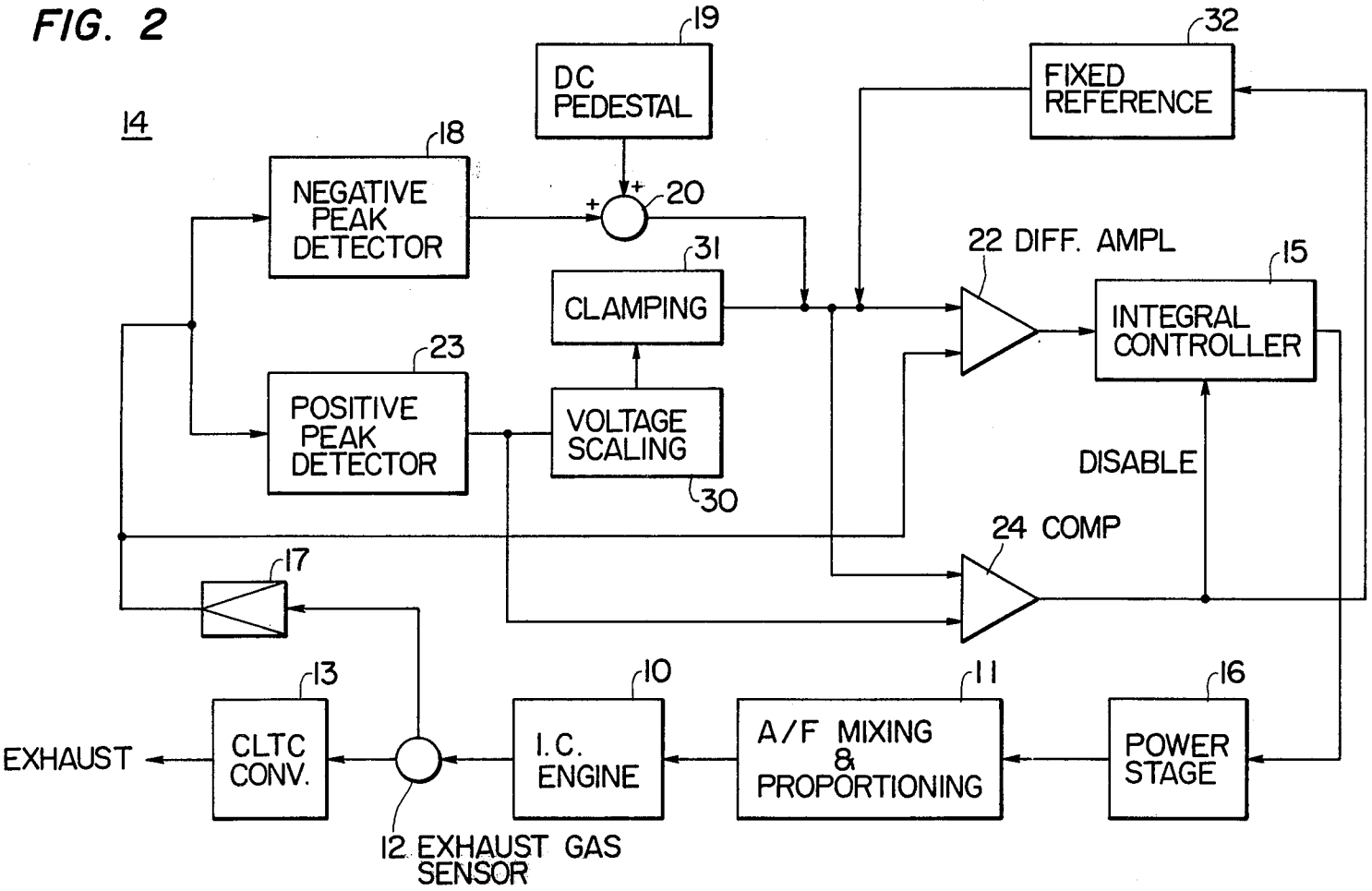
FIG. 2 is a modification of the FIG. 1 embodiment.

A modification of FIG. 1 is illustrated in FIG. 2 in which the same numbers are used to indicate the identical parts to those shown in FIG. 1. A voltage scaling circuit 30 is shown connected to the positive peak detector 23 to scale down the output of the latter to one half of the maximum voltage peak level detected by detector 23. A clamping circuit 31 is shown connected to the scaling circuit 30 clamp the threshold level of differential amplifier 22 to the scaled down voltage so that the threshold is maintained at the scaled down voltage as long as the summation output is below the scaled-down voltage.

Figure 3B:
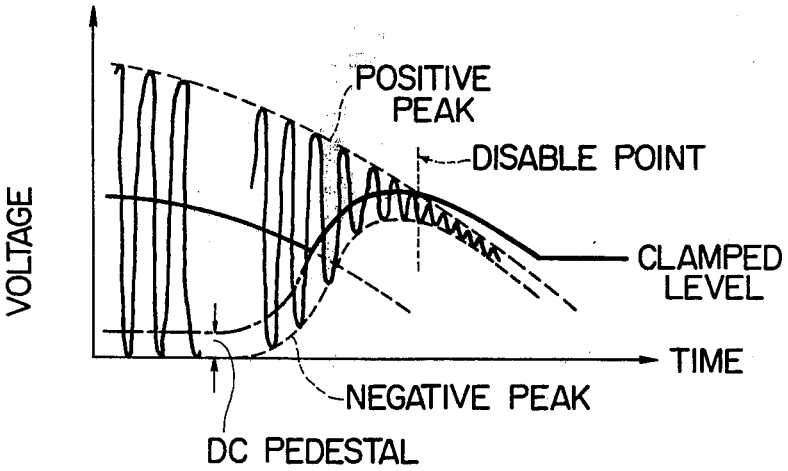

As illustrated in FIG. 3B, the threshold level takes on a valve intermediate the maximum and minimum peak levels as the gas sensor output decreases with time and the intermediate value also decreases along with the maximum peak until it reaches the same voltage level as the summation output, whereupon the threshold takes on the summation output.

Closed-loop suspension is effected when the comparator 24 senses the summation output exceeding the maximum peak in a manner identical to that described above. A fixed reference voltage source 32 is shown connected to the threshold terminal of differential amplifier 22. The output of comparator 24 is shown connected to the source 32 to energize it when closed loop control is disabled to apply the fixed reference voltage to the differential amplifier. This fixed reference is selected at a value intermediate the magnitudes of the maximum and minimum peak levels of the sensor output when the sensor is operating at or above the normal operating temperature. Therefore, during the feedback control suspension the differential amplifier threshold is held at the fixed value which will be readily available for an interval as an appropriate threshold for closed-loop operation when it is resumed.

What is claimed is:

1. In a mixture control system for an internal combustion engine having an exhaust gas sensor for supplying a control signal to the mixture control system, a detection system for detecting when the temperature of the gas sensor is at or above its operating temperature to allow said mixture control system to operate in a closed control mode and generating a disabling signal to operate said control system in an open mode when the temperature of the gas sensor is below its operating temperature, wherein said gas sensor is operable to generate low and high voltage signals in response to the presence and absence, respectively, of a predetermined constituent gas in the exhaust gases when operating at or above its normal operating temperature, said gas sensor having an internal impedance varying inversely with the temperature of said gas sensor from a very high impedance at its low, nonoperable temperature to a very low impedance at its high operating temperature, wherein said high voltage signal decreases with said internal impedance and said low voltage signal increases to approach said decreasing high voltage signal and then decreases with said internal impedance, said detection system comprising:

a differential amplifier having a first input terminal receptive of the output from sad exhaust gas sensor and a second input terminal receptive of a variable reference voltage for generating a differential signal;

a source of voltage of a magnitude intermediate the magnitudes of said high and low voltage signals which will be generated when said exhaust gas sensor is operating at or above its normal operating temperature;

means for detecting said low voltage signal;

means for adding a predetermined constant DC voltage to said detected low voltage signal;

said variable reference voltage being the one of the output from said adding means and said intermediate voltage which is greater than the other;

means for detecting said high voltage signal; and a comparator for generating a comparator output when said variable reference voltage is greater than the detected high voltage signal, said comparator output being said disabling signal.

2. A detection system as claimed in claim 1, wherein said voltage source comprises a voltage scaling circuit connected to said high voltage signal detecting means for scaling down the detected high voltage signal, the output of said scaling circuit being said intermediate voltage.

3. A detection system as claimed in claim 2, further comprising a second voltage source for generating a fixed voltage of a magnitude intermediate the magnitudes of said high and low voltage signals which will be generated when said gas sensor is operating at or above its normal operating temperature, and means for supplying said fixed voltage to the second input terminal of said differential amplifier in response to said disabling signal.

* * * * *